US010018196B2

(12) United States Patent
Honda

(10) Patent No.: US 10,018,196 B2
(45) Date of Patent: Jul. 10, 2018

(54) ROTATING BODY, ROTATING BODY MATERIAL, AND METHOD OF MANUFACTURING ROTATING BODY

(71) Applicant: Diamet Corporation, Niigata-shi (JP)

(72) Inventor: Naotaka Honda, Niigata (JP)

(73) Assignee: DIAMET CORPORATION, Niigata-Shi (JP)

( * ) Notice: Subject to any disclaimer, the term of this patent is extended or adjusted under 35 U.S.C. 154(b) by 0 days.

(21) Appl. No.: 15/106,090

(22) PCT Filed: Jan. 7, 2015

(86) PCT No.: PCT/JP2015/050210
§ 371 (c)(1),
(2) Date: Jun. 17, 2016

(87) PCT Pub. No.: WO2015/107946
PCT Pub. Date: Jul. 23, 2015

(65) Prior Publication Data

US 2017/0002809 A1 Jan. 5, 2017

(30) Foreign Application Priority Data

Jan. 17, 2014 (JP) ..... 2014-006395

(51) Int. Cl.
*F04C 2/08* (2006.01)
*F04C 2/10* (2006.01)
(Continued)

(52) U.S. Cl.
CPC ..... *F04C 2/102* (2013.01); *F04C 2/084* (2013.01); *F04C 15/0073* (2013.01);
(Continued)

(58) Field of Classification Search
None
See application file for complete search history.

(56) References Cited

U.S. PATENT DOCUMENTS 5,272,930 A 12/1993 Nakamura et al.
5,308,122 A * 5/1994 Crawford ..... F16L 25/023 285/332.4
2006/0120908 A1 6/2006 Ohnishi et al.

FOREIGN PATENT DOCUMENTS

CA 1228707 11/1987
JP 59-128987 A 7/1984
(Continued)

OTHER PUBLICATIONS

International Search Report dated Apr. 7, 2015 for the corresponding PCT Application No. PCT/JP2015/050210.
(Continued)

*Primary Examiner* — Adam Krupicka
(74) *Attorney, Agent, or Firm* — Leason Ellis LLP

(57) ABSTRACT

A novel rotating body, its material, and manufacturing method thereof, shortening a distance for cutting a bore surface in its axial direction, reducing processing costs, enabling lower-cost manufacture of inner rotor. A metallic rotating body 11 has a bore surface 12 for press-fitting a shaft thereinto, including a cutting-processed portion 13 at first end and an unprocessed portion 14 at second end. The processed portion 13 has an inner diameter formed smaller than the unprocessed portion 14. A chamfer 15 at first end of the bore surface 12 is cut, while a chamfer 6 at the second end not. A bore surface 2 of material 1 processed into the rotating body 11 includes a small-diameter portion 3 at first end and a large-diameter portion 4 at second end. A step 5 is formed between the small- and large-diameter portions 3, 4, with the chamfer 6 formed at second end.

6 Claims, 1 Drawing Sheet

(51) Int. Cl.
*F04C 15/00* (2006.01)
*F04C 18/10* (2006.01)

(52) U.S. Cl.
CPC ..... *F04C 15/0076* (2013.01); *F04C 18/10* (2013.01); *F04C 2/10* (2013.01); *F04C 2230/10* (2013.01); *F04C 2240/20* (2013.01)

(56) References Cited

FOREIGN PATENT DOCUMENTS

| | | | |
|---|---|---|---|
| JP | 05-15763 | B | 3/1993 |
| JP | 2910087 | B | 6/1999 |
| JP | 3163505 | B | 5/2001 |
| JP | 2002-138968 | A | 5/2002 |
| JP | 3470205 | B | 9/2003 |
| JP | 2003-343451 | A | 12/2003 |
| JP | 2005-264766 | A | 9/2005 |
| JP | 2006-161616 | A | 6/2006 |
| JP | 2009-221950 | A | 10/2009 |
| WO | WO-2012/169024 | A | 12/2012 |

OTHER PUBLICATIONS

Office Action dated Sep. 26, 2017 for the corresponding Japanese Patent Application No. 2014-006395.

* cited by examiner

ROTATING BODY, ROTATING BODY MATERIAL, AND METHOD OF MANUFACTURING ROTATING BODY

CROSS-REFERENCE TO RELATED PATENT APPLICATIONS

This application is a U.S. National Phase Application under 35 U.S.C. § 371 of International Patent Application No. PCT/JP2015/050210, filed Jan. 7, 2015, and claims the benefit of Japanese Patent Application No. 2014-006395, filed on Jan. 7, 2014, all of which are incorporated by reference in their entirety herein. The International Application was published in Japanese on Jul. 23, 2015 as International Publication No. WO/2015/107946 under PCT Article 21(2).

FIELD OF THE INVENTION

The present invention relates to a rotating body such as an inner rotor for an internal gear oil pump that rotates while being pivotally supported by a shaft press-fitted thereinto; a rotating body material; and a method of manufacturing a rotating body.

BACKGROUND OF THE INVENTION

An internal gear oil pump is so configured as to be driven by rotating a shaft fixed to the center of an inner rotor. Then, the inner rotor is securely fixed to the shaft in order to avoid idling being caused by a driving torque of the pump.

Meanwhile, keyway, caulking, press-fitting or the like is being used in general for fixation between an inner rotor and a shaft. However, fixing by way of keyway or caulking has had a problem that a production cost increases due to the increase of assembly processes.

On the other hand, fixing by way of press fitting requires compliance with the strict bore size tolerance requirements as well as reduction of the roughness of the bore surface of an inner rotor in order to ensure a proper press-fitting margin during the cutting process of the bore surface of the inner rotor into which a shaft is press-fitted. For this reason, there has been a problem that the processing cost of such inner rotor increases. Particularly, when processing an elongated inner rotor, a bore surface cutting distance in an axial direction increases, resulting in a higher processing cost.

SUMMARY OF THE INVENTION

Problems to be Solved by the Invention

According to the conventional manufacture of inner rotors, as shown in FIG. 2, a material 51 of an inner rotor 101 has heretofore been formed into a cylindrical tubular shape having an inner surface 52 through a powder metallurgy or the like. Then, in a cutting processing for forming an inner surface 102 of the inner rotor 101, the inner surface 52 has been subjected to a cutting processing by a turning tool or the like so that the inner surface 102 is formed, followed by chamfering through a cutting processing at both end portions of the inner surface 102, thereby forming chamfered portions 103 and 104.

Here, a shaft press-fitting range in an inner rotor is either up to an entire length of an inner or bore surface, or up to only a part thereof. The latter case often applies to an elongated inner rotor. According to the conventional arts, however, even in the latter case, cutting of an entire inner surface has been performed in the past.

It is, therefore, an object of the present invention to provide a novel rotating body, a rotating body material, and a method of manufacturing a rotating body that make it possible to reduce the processing cost of the inner bore surface by shortening an inner surface cutting distance in an axial direction thereof, thus enabling an inner rotor to be produced at a lower cost.

The rotating body according to the present invention features a metallic rotating body into which a shaft is press-fitted, wherein a surface of a bore into which the shaft is press-fitted includes a processed portion that has undergone a cutting processing at a first end, and an unprocessed portion that has not undergone a cutting processing at a second end, and the processed portion is formed to have an inner diameter smaller than an inner diameter of the unprocessed portion.

Also, it features the provision of a chamfered portion on both ends of the surface of the bore, wherein the chamfered portion at the first end is subjected to a cutting processing, while the chamfered portion at the second end is not subjected to a cutting processing.

Also, it features being an inner rotor for an internal gear oil pump.

The rotating body material according to the present invention is the one that is to be processed into a metallic rotating body for press-fitting a shaft thereinto, including:

a surface of a bore including a comparatively small-diameter portion at a first end, and a comparatively large-diameter portion at a second end, the comparatively large-diameter portion having a larger diameter than the comparatively small-diameter portion, wherein a step is formed between the comparatively small-diameter portion and the comparatively large-diameter portion, while a chamfered portion is formed at the second end.

Also, it features being obtained by powder metallurgy.

Still also, it features the rotating body being an inner rotor for an internal gear oil pump.

The method of manufacturing a rotating body according to the present invention features a method of manufacturing a metallic rotating body into which a shaft is press-fitted, including:

a material-forming step of forming a rotating body material; and a cutting-processing step of allowing the rotating body material to undergo a cutting processing, wherein a bore surface of the rotating body material formed at the material-forming step includes a comparatively small-diameter portion at a first end, and a comparatively large-diameter portion at a second end, the comparatively large-diameter portion having a larger diameter than the comparatively small-diameter portion, wherein a step is formed between the comparatively small-diameter portion and the comparatively large-diameter portion, while a chamfered portion is formed at the second end, and wherein only the comparatively small-diameter portion is subjected to a cutting processing at the cutting processing step.

Also, it features the rotating body being an inner rotor for an internal gear oil pump.

Effects of the Invention

According to the rotating body of the present invention, only a part of the bore surface is subjected to a cutting processing, and thus the cutting distance of the bore surface in the bore axis direction is shortened, thereby reducing the processing cost of the bore surface, enabling the manufacturing of the same at a lower cost.

According to the rotating body material of the present invention, it is configured such that only a part of the bore surface is subjected to a cutting processing, and thus the cutting distance of the bore surface in the bore axis direction is shortened, thereby reducing the processing cost of the bore surface, enabling the manufacturing of the same at a lower cost.

According to the method of manufacturing a rotating body of the present invention, only a part of the bore surface of the rotating body material is subjected to a cutting processing, and thus the cutting distance of the bore surface in the bore axis direction is shortened, thereby reducing the processing cost of the bore surface, enabling the manufacturing of the same at a lower cost.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Next is a description of a rotating body, a rotating body material, and a method of manufacturing the rotating body according to an embodiment of the present invention, with reference to the drawings.

Embodiment 1

Figure 1:
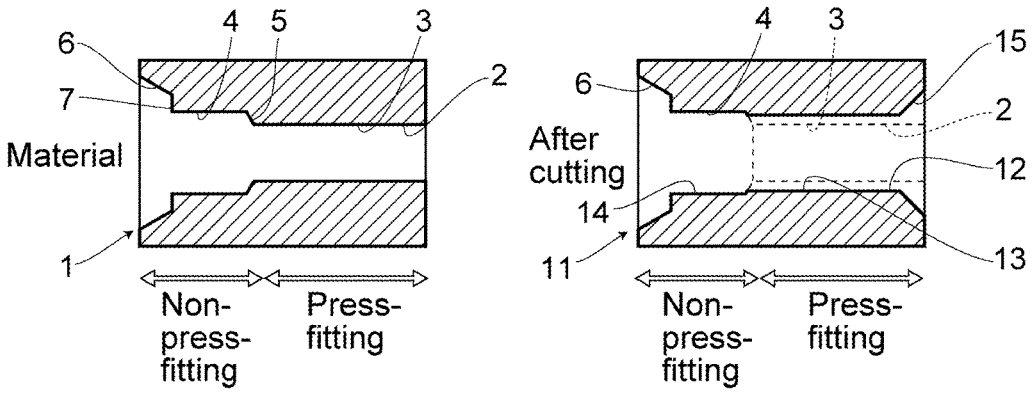
FIG. 1 is an explanatory diagram illustrating an embodiment of a method of manufacturing a rotating body according to the present invention.
Figure 2:
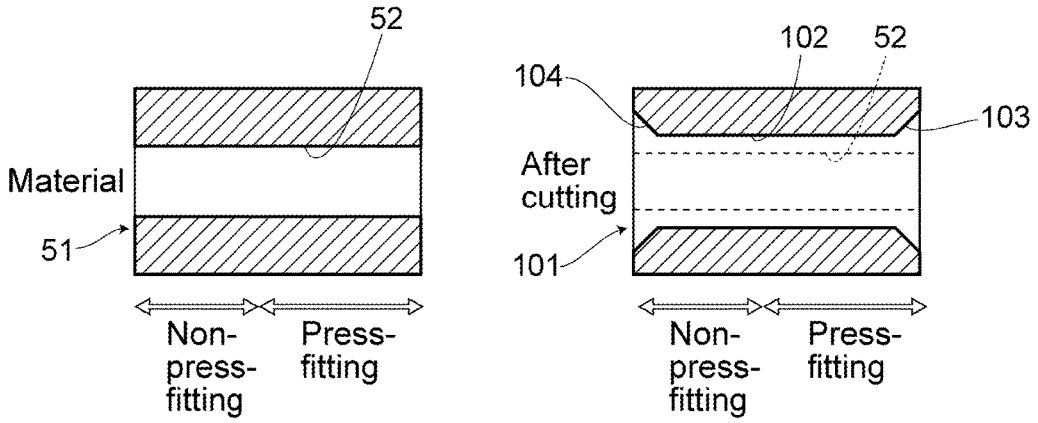
FIG. 2 (Prior Art)
FIG. 2 is an explanatory diagram illustrating a conventional method of manufacturing a rotating body.

The rotating body according to the present embodiment is an inner rotor for an internal gear oil pump made of a ferrous metal. In FIG. 1 showing a method of manufacturing a rotating body of the present embodiment, there are illustrated a material 1 as a rotating body material at the left side thereof, and a rotating body 11, obtained by allowing the rotating body material to be subjected to a cutting processing, at the right side thereof. It is to be noted herein that FIG. 1 is only an explanatory diagram schematically and mainly showing a bore surface into which a shaft (not shown) is press-fitted, and not intended to show the actual shape of the inner rotor, etc.

At the left side of FIG. 1, the material 1 is the one obtained by powder metallurgy in which a metal powder is molded and then baked, including a bore surface 2 of a substantially cylindrical shape. The bore surface 2 includes a small-diameter portion 3 at a first end and a large-diameter portion 4 at a second end such that the small-diameter portion 3 and the large-diameter portion 4 extend in a linear manner, each defining a constant inner diameter. Since the small-diameter portion 3 is to be subjected to a cutting processing described later, its inner diameter is set smaller than that of the large-diameter portion 4 to ensure a processing margin, while there is formed a step 5 between the small-diameter portion 3 and the large-diameter portion 4. Also, a chamfered portion 6 is formed at the second end. Meanwhile, a step 7 between the chamfered portion 6 and the large-diameter portion 4 is the one formed for convenience of molding in powder metallurgy.

On the other hand, at the right side in FIG. 1, there is illustrated the rotating body 11 that is formed by allowing only the small-diameter portion 3 of the material 1 to be subjected to the cutting processing. That is, the inner bore surface 12 of the rotating body 11 includes a processed portion 13 that has undergone a cutting processing at a first end, and an unprocessed portion 14 that has not undergone a cutting processing at a second end. Accordingly, the large-diameter portion 4 of the material 1 is identical to the unprocessed portion 14 of the rotating body 11. In this way, in the inner bore surface 12 of the rotating body 11, only the processed portion 13 that defines a range in which the shaft is press-fitted is formed by the cutting processing, and thus the cutting distance of the inner bore surface 12 in the bore axis direction is shortened, so that the processing cost of the bore surface is reduced. According to the present embodiment, the processed portion 13 occupies ½ to ⅔ area of the bore surface 12 in the bore axis direction, thereby enabling the reduction of the processing cost in the remaining ⅓ to ½ area. Moreover, the resultant decreased cutting distance leads to a prolonged life of a cutting tool used for the cutting processing, resulting in the reduction of costs incurred by the cutting tool.

Here, since the unprocessed portion 14, which defines a range in which the shaft is not press-fitted, may serve to guide the shaft when press-fitting the shaft, the difference in inner diameter between the processed portion 13 and the unprocessed portion 14 should preferably be as small as possible. On the other hand, in order to efficiently process only the processed portion 13 without the unprocessed portion 14 being hit by the cutting tool such as turning tool during the cutting processing, the inner diameter of the unprocessed portion 14 should desirably be set larger than the inner diameter of the processed portion 13. For this reason, the inner diameter of the processed portion 13 is formed so slightly smaller than the inner diameter of the unprocessed portion 14 that the bore surface 12 thereof defines a shape close to a straight and linear shape in the conventional inner rotors. Incidentally, the difference in inner diameter between the processed portion 13 and the processed portion 14 is in the order of 0.01 to 0.02 mm, for example.

Also, the bore surface 12 is provided with a chamfered portion 15 at its distal end on the first end side that is formed by performing a cutting processing. Note that the chamfered portion 6 at the opposite end portion on the second end side is not subjected to a cutting processing, and hence it remains the same as it was in the material 1. In this manner, forming in advance the chamfered portion 6 at the end portion on the second end side in the material 1 can eliminate the need for the step of forming the chamfered portion 6 by a cutting processing, thereby enabling the reduction of the processing cost.

As discussed above, the rotating body according to the present embodiment is the metallic rotating body 11 into which a shaft is press-fitted, wherein the bore surface 12 into which the shaft is press-fitted includes the processed portion 13 that has undergone a cutting processing at the first end, and the unprocessed portion 14 that has not undergone a cutting processing at the second end, and the processed portion 13 is formed to have an inner diameter smaller than an inner diameter of the unprocessed portion 14. Also, the chamfered portion is provided on both ends of the bore surface 12, wherein the chamfered portion 15 at the first end is the one subjected to a cutting processing, while the chamfered portion at the second end is not the one subjected to a cutting processing.

Also, the rotating body material according to the present embodiment is the material 1 serving as a rotating body material that is to be processed into the metallic rotating body 11 into which a shaft is press-fitted, including:

the bore surface 2 including the comparatively small-diameter portion 3 at the first end, and the comparatively large-diameter portion 4 at the second end, the comparatively large-diameter portion 4 having a larger diameter than the comparatively small-diameter portion 3, wherein the step 5 is formed between the comparatively small-diameter portion 3 and the comparatively large-diameter portion 4, while the chamfered portion 6 is formed at the second end.

Still also, the method of manufacturing a rotating body according to the present invention is the method of manufacturing the metallic rotating body 11 into which a shaft is press-fitted, including:

a material-forming step of forming the material 1; and a cutting-processing step of allowing the material 1 to undergo a cutting processing, wherein the bore surface 2 of the material 1 formed at the material-forming step includes the comparatively small-diameter portion 3 at the first end, and the comparatively large-diameter portion 4 at the second end, the comparatively large-diameter portion 4 having a larger diameter than the comparatively small-diameter portion 3, wherein the step 5 is formed between the comparatively small-diameter portion 3 and the comparatively large-diameter portion 4, while the chamfered portion 6 is formed at the second end, and wherein only the comparatively small-diameter portion 3 is subjected to a cutting processing at the cutting processing step.

Accordingly, the cutting distance of the bore surface 12 in the bore axis direction is shortened, thereby reducing the processing cost of the bore surface. Moreover, the resultant decreased cutting distance leads to a prolonged life of a cutting tool used for the cutting processing, resulting in the reduction of costs incurred by the cutting tool.

In the meantime, the present invention is not limited to the foregoing embodiment. For example, the material is not limited to the one formed by powder metallurgy, but may be one formed by casting or forging. Also, the rotating body is not limited to an inner rotor for an internal gear oil pump.

DESCRIPTION OF SYMBOLS

1 material (rotating body material)
2 bore surface
3 small-diameter portion
4 large-diameter portion
5 step
6 chamfered portion
11 rotating body
12 bore surface
13 processed portion
14 unprocessed portion
15 chamfered portion

The invention claimed is:

1. A rotating body made of metal into which a shaft can be press-fit, comprising:

a bore surface including a processed portion at a first end that has undergone a cutting process such that it is straight and linear so as to accommodate press-fitting of the shaft and an unprocessed portion provided at a second end, wherein the processed portion has an inner diameter smaller than an inner diameter of the unprocessed portion, and the difference in an inner diameter between the processed portion and the unprocessed portion is in a range from 0.01 to 0.02 mm.

2. The rotating body according to claim 1, further comprising a chamfered portion on each of the first and second ends the bore surface, wherein the chamfered portion at the first end is formed during the cutting processing, while the chamfered portion at the second end has not undergone a cutting processing.

3. The rotating body according to claim 1, wherein the rotating body is an inner rotor for an internal gear oil pump.

4. The rotating body according to claim 1, wherein, the processed portion occupies ½ to ⅔ of the area of the bore surface in a bore axis direction.

5. The rotating body according to claim 4, further comprising a chamfered portion on each of the first and second ends the bore surface, wherein the chamfered portion at the first end is formed during the cutting processing, while the chamfered portion at the second end has not undergone a cutting processing.

6. The rotating body according to claim 4, wherein the rotating body is an inner rotor for an internal gear oil pump.

* * * * *